US006278242B1

(12) United States Patent
Cok et al.

(10) Patent No.: US 6,278,242 B1
(45) Date of Patent: Aug. 21, 2001

(54) SOLID STATE EMISSIVE DISPLAY WITH ON-DEMAND REFRESH

(75) Inventors: Ronald S. Cok, Rochester; Paul P. Lee, Pittsford, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/528,900

(22) Filed: Mar. 20, 2000

(51) Int. Cl.[7] ..... H01J 9/00
(52) U.S. Cl. ..... 315/169.1; 315/169.3
(58) Field of Search ..... 315/169.3, 169.1, 315/169.2, 169.4; 313/495, 498

(56) References Cited

U.S. PATENT DOCUMENTS

| | | | | |
|---|---|---|---|---|
| 4,769,292 | | 9/1988 | Tang et al. | 428/690 |
| 5,061,569 | | 10/1991 | VanSlyke et al. | 428/457 |
| 5,463,279 | * | 10/1995 | Khormael | 315/169.3 |
| 5,552,678 | | 9/1996 | Tang et al. | 315/169.3 |

FOREIGN PATENT DOCUMENTS

0905673A1 3/1999 (EP) .

OTHER PUBLICATIONS

Dawson et al., "A Polysilicon Active Matrix Organic Light Emitting Diode Display with Integrated Drivers," *Society for Information Display Digest,* 1988, pp. 11–14.

* cited by examiner

*Primary Examiner*—David Vu
(74) *Attorney, Agent, or Firm*—Thomas H. Close

(57) ABSTRACT

A display device, including: a light controlling element; a drive circuit connected to the light controlling element, the drive circuit including a transistor having a gate for controlling the power applied to the light controlling element; a storage capacitor connected to the gate of the drive circuit transistor; a control circuit for depositing charge on the storage capacitor; a refresh circuit connected to the control circuit and responsive to an external signal for causing the control circuit to deposit charge on the storage capacitor; and a feedback mechanism including element for measuring a change in a performance characteristic of the display device and for signaling the refresh circuit in response to the measured characteristic, whereby the display is refreshed on demand as opposed to periodically.

12 Claims, 3 Drawing Sheets

SOLID STATE EMISSIVE DISPLAY WITH ON-DEMAND REFRESH

FIELD OF THE INVENTION

The present invention relates to solid-state display devices and means to store and display pixel values and images.

BACKGROUND OF THE INVENTION

Solid state image display devices utilizing emissive pixels are well known and widely used. Much work has been done to improve the brightness, uniformity, contrast, etc. of the displays so as to make them as pleasing as possible. For example, European Patent Application EP 0 905 673 A1, by Kane et al., published Mar. 31, 1999, entitled "Active Matrix Display System and a Method for Driving the Same" and the article entitled "A Poly-Silicon Active Matrix Organic Light Emitting Diode Display with Integrated Drivers" by Dawson et al., published in the society for Information Display Digest, 1998, pp. 11–14, describe such efforts. Generally speaking, these devices require power to maintain their information state (they are volatile) and because of charge leakage, can only maintain and display an image for a limited amount of time after which it begins to fade (they are not persistent). The image is then refreshed, that is the image is rewritten into the display device. Refresh circuitry can be complex, require high data rates, and impose a significant cost and size burden on a system. In particular, refreshing a display requires a significant use of system power. The frequency with which the display must be rewritten depends on the persistence of the display (how long it can maintain an acceptable image) and the rate at which the image content changes. If the image content changes more frequently than the rate at which the image fades, there will never be a problem. This is generally the case in video-rate systems. However, in cases where the content changes slowly or where only portions of an image change, frequent display refreshes may be unnecessary. Indeed, a persistent imaging system designed for still images alone may not require periodic refresh capability.

Solid-state displays can be characterized as emissive or non-emissive. An emissive display directly generates light at each pixel and requires power to operate and display information. Liquid crystal displays (LCDs), in contrast, are non-emissive and maintain their state without drawing significant current. (LCDs are non-volatile although power is needed to make their state visible either through backlighting or ambient light, or to change their state. The switched state is maintained through an applied electrostatic field.) The liquid crystals themselves do not emit light but rather change the polarization of light passing through them. LCDs are thus non-emissive and generally utilize a backlight to make their display visible. A non-volatile display is, by definition, persistent.

Solid-state image displays are typically organized by address and data controls representing the value of each pixel in the display. The address is converted into a select line (or combination of select lines) controlling an individual pixel and a data line representing the analog value of the pixel. Each pixel is then managed by the Data and Select control lines and incorporates means to store a charge representing the value of the pixel at the pixel site, and a mechanism to emit light from the stored charge. The control mechanisms are generally implemented using transistors and the storage mechanisms through capacitors. U.S. Pat. No. 5,552,678 issued Sep. 3, 1996 to Tang et al., entitled "AC Drive Scheme for Organic LED" describes a specific drive scheme for an implementation using organic LEDs.

FIG. 1 represents a generic diagram implementing a display pixel in an LED display. In this figure, the pixel 10 has a control mechanism 12 that stores charge in a capacitor 14 which then drives a display mechanism. The transistor Tc 12 is responsive to the control lines (Data 16 and Select 18) and, when active, deposits a charge into Cref 14. Cref then controls the driver, Td 20, for an LED display component 22. Td 20 is optimized to effectively drive the LED 22; Tc 12 to charge the storage capacitor 14 and respond to the control lines 16 & 18. To perform these tasks, both transistors 12 & 20 tend to be large; Tc 12 to provide fast switching time and Td 20 to provide the maximum current (and brightness) through the LED 22.

The persistence of the display is directly related to the length of time that the storage capacitor can maintain its charge. There are three basic mechanisms through which this charge can dissipate. The first leakage path is directly across the capacitor indicated by arrow 24 and will be affected by the materials and structures used to implement the device. Second, charge is used to drive the display mechanism which provides a second leakage path indicated by arrow 26. Third, charge can leak back through the control mechanism indicated by arrow 28. These leakage paths are illustrated with the curved arrows in FIG. 1. Leakage through the capacitor itself is exacerbated by material impurities; leakage back through Tc is attributed to source-to-drain and source-to-gate leakage; and through Td by gate-to-source leakage. The leakage through the transistors is greater for larger transistors.

Because of the inherent loss of charge at each pixel site in a display device, the devices must be periodically refreshed, i.e. the image data must be rewritten to the display. FIG. 2 illustrates a generic system. As shown in FIG. 2, an imaging system 40 includes a display device 42, a refresh circuit 44 and a control circuit 46. The refresh circuit 44 receives a periodic signal 48 instructing it to refresh the image display. The need for periodic refresh in an image display system for displaying still images imposes system costs by enforcing potentially unnecessary refresh requirements. These system costs can include design effort, manufacturing costs, complexity, performance, reduced system reliability, and power. There is a need therefore for an improved image display with reduced refresh needs that is less costly to manufacture, has a simpler design and exhibits improved performance over the prior art devices.

SUMMARY OF THE INVENTION

The above noted need is met according to the present invention by providing a display device, including: a light controlling element; a drive circuit connected to the light controlling element, the drive circuit including a transistor having a gate for controlling the power applied to the light controlling element; a storage capacitor connected to the gate of the drive circuit transistor; a control circuit for depositing charge on the storage capacitor; a refresh circuit connected to the control circuit and responsive to an external signal for causing the control circuit to deposit charge on the storage capacitor; and a feedback mechanism including means for measuring a change in a performance characteristic of the display device and for signaling the refresh circuit in response to the measured characteristic, whereby the display is refreshed on demand as opposed to periodically.

ADVANTAGES

The advantages of this invention are a digital, solid-state emissive display device with reduced refresh costs. A display system using this invention will also have reduced power needs for low data-rate imaging.

DETAILED DESCRIPTION OF THE INVENTION

The foregoing objections to the display of digital images in a solid-state device at low image rates is addressed according to the present invention by implementing a refresh-on-demand feedback signal. A refresh-on-demand signal takes information from the display and signals the larger system of which the display is a part when a refresh for the display is necessary.

Figure 1:
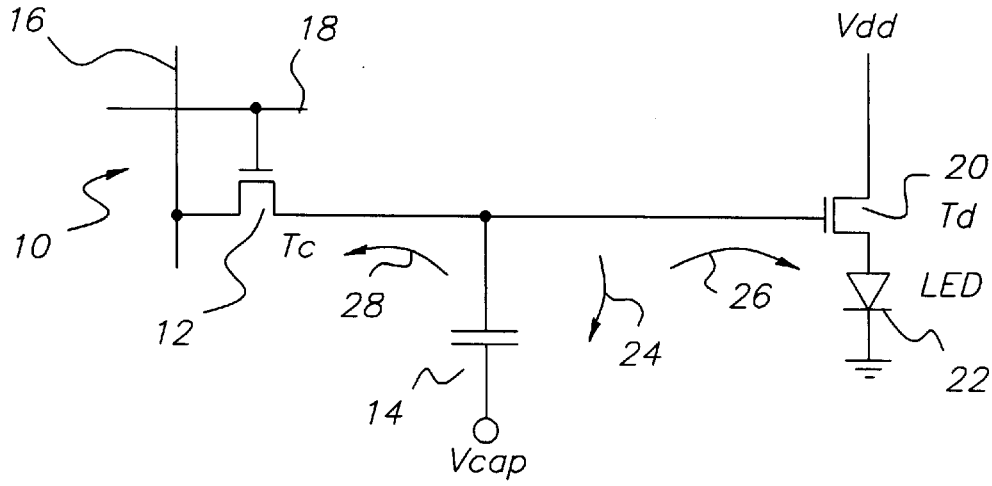
FIG. 1 (PRIOR ART)
FIG. 1 is a generic circuit diagram of pixel circuitry known in the art and used in a solid-state display and indicating the charge leakage paths.
Figure 2:
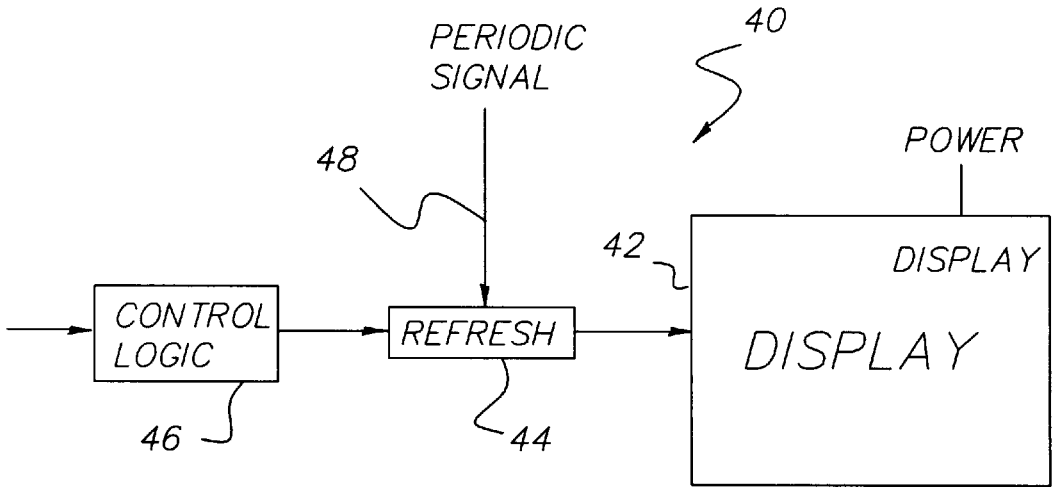
FIG. 2 (PRIOR ART)
FIG. 2 is a generic block diagram of a prior art image display system with control and refresh logic.
Figure 3:
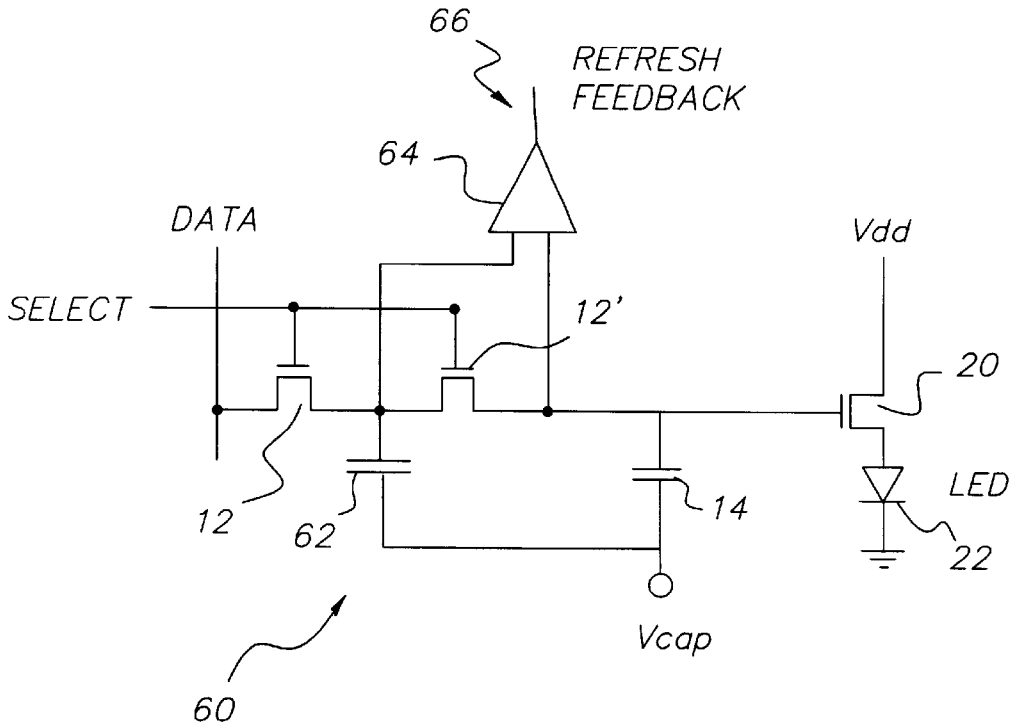
FIG. 3 is a circuit diagram showing one embodiment of pixel circuitry according to the present invention.
Figure 4:
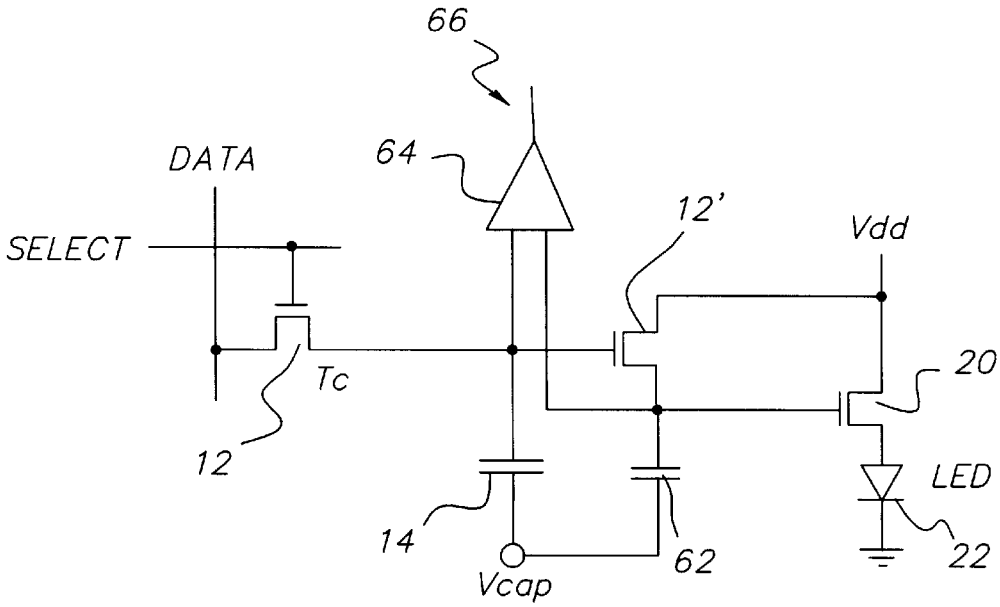
FIG. 4 is a circuit diagram showing a second embodiment of pixel circuitry according to the present invention.

The refresh on demand feedback mechanism instructs the system to refresh the data at each pixel site only when necessary. FIG. 3 illustrates one possible approach 60. By using two storage capacitors 62 and 14 separated by a second transistor 12' and comparing their state with a comparator 64, a signal 66 is generated to indicate when a refresh is needed. When the charge on the two storage capacitors 62 and 14 differs significantly, the system is instructed to refresh the pixel 60 by refresh feedback signal 66. According to an alternative embodiment as shown in FIG. 4, a second capacitor 62 is separated from the reference capacitor 14 by transistor 12', while the other components are as described in FIG. 3. It is important that the voltage comparator 64 provide as little leakage as possible since its addition represents an alternative leakage mechanism. Fortunately, such comparators can be created with very small, high-impedance transistors, and their design is well-known in the art. Moreover, the comparator need not be fast.

Other mechanisms for measuring the persistence of a pixel are feasible. For example, the comparison of resistance, impedance, voltage drop, or current through various portions of the pixel circuitry, particularly the light emitting element itself, can indicate changes in pixel display. When compared with a known value, any change so noted can be used to initiate a refresh.

The refresh feedback signal 66 can be treated in a number of ways in the system. For example, in order to reduce design overhead only a subset of the pixels might implement feedback. The subset might be a regular sample of the entire display or a portion of the display. Alternatively, a single reference pixel can be used to represent the entire display. Alternatively, a reference pixel for each color can be used. Reference pixels have the advantage that the measurement overhead is limited to the reference pixel(s) alone, thus reducing the cost of measurement and supporting more complex and sophisticated monitoring of the pixel behavior. The reference pixels can be used as worst cases indicating when any pixel might need a refresh or a reference pixel can be used to represent the average pixel's need for refresh. Alternatively, a feedback mechanism at each pixel site can be employed to support the refresh of only those pixels in a display that need it. This can be particularly useful if content changes on only a portion of the display.

The feedback signals can be handled through conventional computer control and digital logic. The feedback signals can be aggregated into a single refresh for an entire display or for areas within the display. The pixels can be sampled, polled or continuously monitored to obtain the feedback signal. The supporting refresh feedback circuitry may be integrated with the display electronics on the display substrate or in circuitry external to the display device itself.

Figure 5:
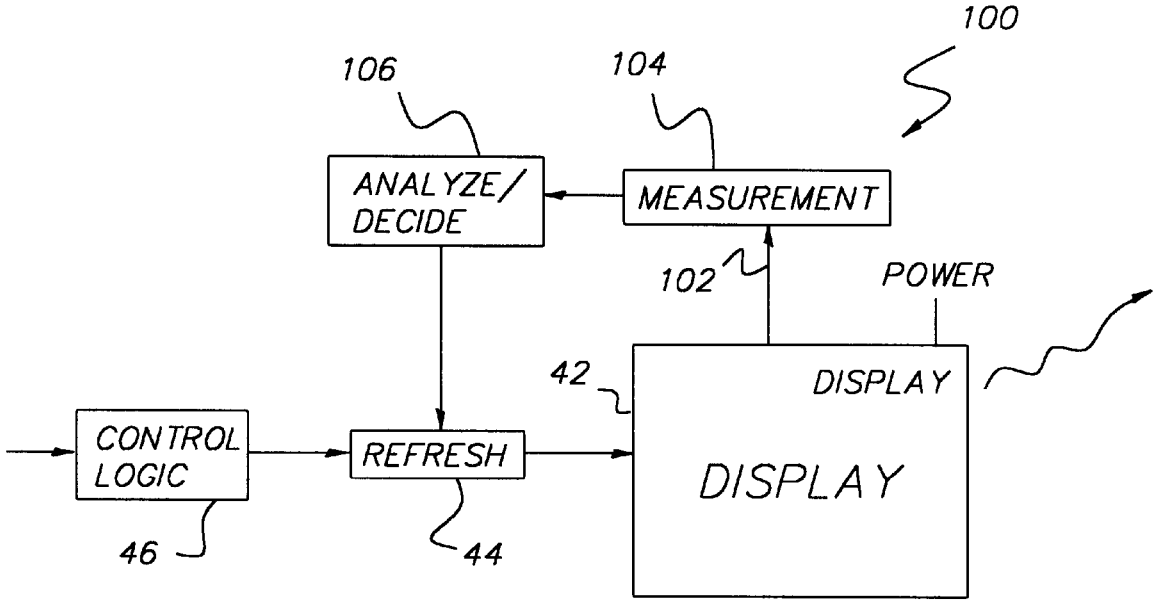
FIG. 5 is a block diagram showing one embodiment a display system according to the present invention.

Referring to FIG. 5, a display device 100 according to the present invention is shown. Once generated, the refresh feedback signal 102 is processed and used by the display control logic to initiate a refresh cycle. The refresh feedback signals 102 from one or more pixels in the display are measured 104 and the measurements (resistance, impedance, voltage drop, or current through various portions of the pixel circuitry) are supplied to an analysis/decision circuit 106. The analysis/decision circuit 106 compares the signal to a predetermined value, uses the measurements in a predictive model of the performance of the pixels or measures the change in the measured values over time and decides when a refresh should be initiated. The threshold chosen for making the decision to refresh depends on the desired tradeoff of system attributes such as power consumption, image quality, and design complexity. Once the analysis/decision circuit 106 determines that a refresh should be initiated, it signals the refresh logic 44 and the refresh logic 44 initiates an image display refresh.

Generally, an image display device that supports refresh on demand according to the present invention is most useful when image content changes slowly or incompletely. Displays may even be customized so that only some portions of the display incorporate refresh-on-demand, reducing the need for refreshing in those areas that are unlikely to change frequently (such as icons).

The implementation of displays with a refresh-on-demand capability reduces the need for system refresh at arbitrary or periodic intervals. This in turn reduces the power consumption of the system and minimizes the need for system support at unnecessarily high data rates providing design, power, and cost savings to the solid-state display system.

In a preferred embodiment, the invention is employed in an emissive display that includes Organic Light Emitting Diodes (OLEDs) which are composed of small molecule polymeric OLEDs as disclosed in but not limited to U.S. Pat. No. 4,769,292, issued Sep. 6, 1988 to Tang et al., entitled "Electroluminescent Device with Modified Thin Film Luminescent Zone" and U.S. Pat. No. 5,061,569, issued Oct. 29, 1991 to VanSlyke et al., entitled "Electroluminescent Device with Organic Electroluminescent Medium." Many combinations and variations of OLED materials are available to those knowledgeable in the art, and can be used to fabricate a display device according to the present invention. OLED displays can be integrated in a micro-circuit on a conventional silicon substrate. Alternatively, OLED devices may be integrated upon other substrates, such as glass. The deposited silicon materials may be single-crystal in nature or be amorphous, polycrystalline, or continuous grain. These deposited materials and substrates are known in the prior art and this invention may be applied equally to any micro-circuit integrated on a suitable substrate.

Although the invention has been described with reference to a display employing light emitting elements, it will be understood that any light controlling element, such as a light emitting diode display, a liquid crystal display, or a plasma display can be employed in the present invention.

The invention has been described in detail with particular reference to certain preferred embodiments thereof, but it will be understood that variations and modifications can be effected within the spirit and scope of the invention.

| PARTS LIST | |
|---|---|
| 10 | pixel |
| 12, 12' | transistor |
| 14 | capacitor |
| 16 | control line |
| 18 | control line |
| 20 | transistor |
| 22 | LED display component |
| 24 | capacitor leakage path |
| 26 | display mechanism leakage path |
| 28 | control mechanism leakage path |
| 40 | generic image display system |
| 42 | display |
| 44 | refresh circuitry |
| 46 | control circuitry |
| 48 | periodic input signal |
| 60 | pixel |
| 62 | capacitor |
| 64 | voltage comparator |
| 66 | pixel |
| 80 | capacitor |
| 100 | display device |
| 102 | refresh feedback signals |
| 104 | measurement circuitry |
| 106 | analysis circuitry |

What is claimed is:

1. A display device, comprising:

a) a light controlling element;

b) a drive circuit connected to the light controlling element, the drive circuit including a transistor having a gate for controlling the signal applied to the light controlling element;

c) a first storage capacitor connected to the gate of the drive circuit transistor;

d) a control circuit for depositing charge on the first storage capacitor;

e) a refresh circuit connected to the control circuit and responsive to an external signal for causing the control circuit to deposit charge on the first storage capacitor; and f) a feedback mechanism including means for measuring a change in a performance characteristic of the display device and for signaling the refresh circuit in response to the measured performance characteristic, whereby the display is refreshed on demand as opposed to periodically.

2. The display device claimed in claim 1, wherein the performance characteristic is the charge level on the storage capacitor.

3. The display device claimed in claim 1, wherein the performance characteristic is the light output of the light controlling element.

4. The display device claimed in claim 1, wherein the performance characteristic is the power applied to the light controlling element.

5. The display device claimed in claim 1, including a plurality of light control elements and a separate feedback mechanism for each light control element.

6. The display device claimed in claim 1, including a plurality of light control elements, and a separate feed back mechanism for subsets of the light control elements.

7. The display device claimed in claim 1, including a plurality of light control elements and a further light control element that is not visible as part of the display, and the feedback mechanism being responsive to the characteristics of only the further light control element.

8. The display claimed in claim 1, wherein the feedback mechanism includes a second storage capacitor isolated from the first storage capacitor and bearing an identical charge to the first storage capacitor and a voltage comparator connected to the first and second storage capacitors for comparing the states of the first and second storage capacitors.

9. The display claimed in claim 1, including a plurality of colored light control elements and a further light control element for each color that is not visible as part of the display, and the feedback mechanism being responsive to the characteristics of only the further light control elements.

10. The display device claimed in claim 1, wherein the light control element is an organic light emitting diode (OLED).

11. The display device claimed in claim 10 wherein the OLED is deposited on a single-crystal Silicon substrate.

12. The display device claimed in claim 10 wherein the OLED is deposited on a glass substrate together with amorphous, polycrystalline, or continuous grain Silicon materials.

* * * * *